United States Patent [19]

Jackson

[11] Patent Number: 4,986,539

[45] Date of Patent: Jan. 22, 1991

[54] MAGNETIC BALL AND JACK SET

[76] Inventor: Walter L. Jackson, 8830 Ellsworth Cir., Santee, Calif. 92071

[21] Appl. No.: 367,248

[22] Filed: Jun. 16, 1989

[51] Int. Cl.[5] ..... A63F 9/07

[52] U.S. Cl. ..... 273/1 GD; 273/199

[58] Field of Search ..... 273/1 G, 1 GD, 1 GG, 273/317, 56 A; D21/51

[56] References Cited

U.S. PATENT DOCUMENTS

| | | | |
|---|---|---|---|
| D. 70,800 | 8/1926 | MacDonald | D21/51 |
| 2,277,057 | 3/1942 | Bach | 273/58 A X |
| 2,286,368 | 6/1942 | May | D21/51 X |
| 2,596,439 | 5/1952 | Rose | 273/1 GD X |

*Primary Examiner*—Paul E. Shapiro

[57] ABSTRACT

A ball and jack set is characterized by a ball which is made magnetic by virtue of an encapsulated magnet, and jacks which have three orgthogonal bars characteristic of most such jacks, but one of the bars is made of a ferromagnetic material, with the other two being plastic. The jacks cooperate with the ball by clinging to it because of the magnetic attraction between the ball and the ferromagnetic arm of the jacks, with the other two arms of the jacks being very lightweight plastic, such that a good balance of magnetic attraction, low production cost, and light weight is achieved. The purpose of the magnetic feature is to permit the user to easily gather the jacks together by simply moving the ball around near or into contact with the jacks until they all cluster together around the ball.

9 Claims, 1 Drawing Sheet

MAGNETIC BALL AND JACK SET

BACKGROUND OF THE INVENTION

The ball and jacks has been around seemingly eternally, and may go back for centuries. The game is played by bouncing the ball with one hand, and then picking up as many jacks as possible with the same hand, before catching the ball in the same hand before it bounces again. Alternate players do the same thing, and the one who gathers the most jacks and still successfully catches the ball before it bounces wins.

A problem with the game of balls and jacks lies in the number of small parts, namely jacks and the ball, which are necessary to play the game. As with any game with many small parts, the parts tend to get lost, and it is a nuisance to pick them up and keep them together when the game is not being used.

There is a need, therefore, for a ball and jacks set that incorporates features that will permit the jacks and the ball to be grouped and kept together easily, minimizing the chances of losing a jack, and maximizing the ease with which the parts can be grouped and kept together when not in use.

SUMMARY OF THE INVENTION

The instant invention fulfills the above stated need and provides a ball and jack set wherein the ball is made magnetic, and the jacks have at least one crossbar which is ferromagnetic, and will be attracted to the magnetic ball. Thus when the game is finished, the ball can be swept through the jacks, with the jacks clinging to the ball as it is moved through the jacks.

Certain design criteria enable the set to be effective, and maximize the economy of making the jacks and the ball, and the effectiveness of the clinging action. In summary, the jacks are made of two integral plastic crossbars which take the form of four radial spokes in the same plane, with an orthogonal ferromagnetic crossbar passing through the center of the plastic crossbars.

DETAILED DESCRIPTION OF THE PREFERRED EMBODIMENT

Figure 1:
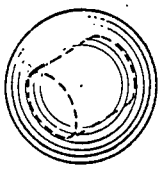
FIG. 1 is a perspective view of the ball illustrating a completely encapsulated cylindrical magnet inside in phantom.
Figure 2:
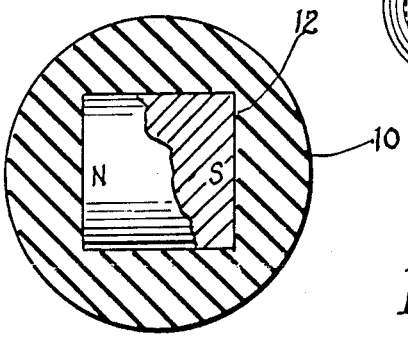
FIG. 2 is an enlarged section taken through the ball showing the encapsulated magnet with a portion cut away.
Figure 3:
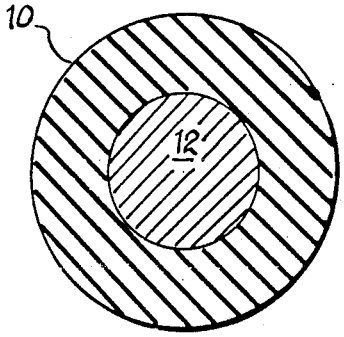
FIG. 3 is an enlarged section taken transversely of the cylindrical axis of the magnet.

The invention is fairly simple and straightforward in nature, and comprises a ball 10, which is of no special material but can be any ball with adequate resilience and bounce to work properly in the game of jacks. The ball is modified however, as shown in FIGS. 1 through 3, to completely encapsulate a rather thick-bodied cylindrical magnet 12. The material of the ball itself is non-magnetic, and does not substantially impede the magnetic flux lines, so that the magnet 12 produces a strong magnetic field outside of the ball. The magnet inside the ball is spaced sufficiently inwardly from the surface of the ball so that the resilience of the ball is not impeded to the point that the bounce would be erratic, or inadequate.

Typically, the cylinder would be about half an inch long and half an inch in diameter, with the ball being one inch in diameter. The ball is about an inch in diameter, so that there is approximately a quarter of an inch at the ends and along the sides of the magnet separating it from the spherical surface of the ball.

Figure 4:
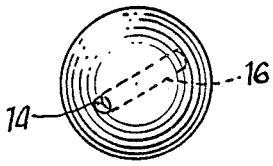
FIG. 4 is a perspective view of a slight modification of the ball wherein a bar magnet is inserted through a bore through the ball.
Figure 5:
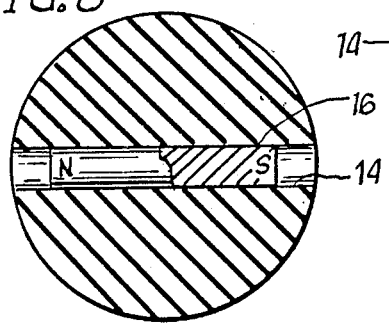
FIG. 5 is an enlarged section taken through the ball of FIG. 4 substantially through the axis of the magnet with a portion of the magnet cut away.
Figure 6:
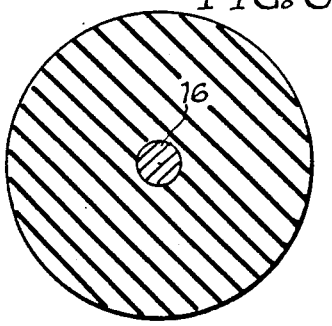
FIG. 6 is an enlarged section taken through the ball of FIGS. 4 and 5, perpendicular to the magnetic axis.
Figure 7:
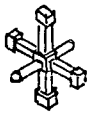
FIG. 7 is a perspective view of a typical jack.
Figure 8:
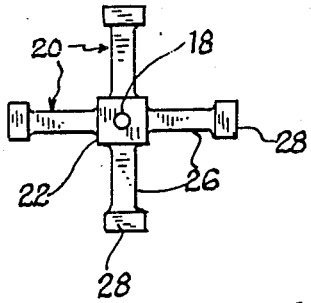
FIG. 8 is an enlarged end elevation view of the jack, taken along the axis of the ferromagnetic crossbar.

A slight modification of the ball, which is somewhat less expensive to make and is equally effective, is shown in FIGS. 4 through 6. In this embodiment, the ball is provided with a cylindrical bore 14 which passes through the center of the ball, and an elongated, preferably cylindrical magnet 16 is inserted into the bore 14. The length of the magnet should be such that there is one sixteenth to three thirty-seconds of an inch clearance between the ends of the magnet and the projected surface of the ball at the ends of the bore. This clearance is adequate to permit the ball to bounce evenly at the ends of the bore, without noticeably causing the bounce to be dampened by the magnet or otherwise made erratic.

The ball made according to either of the embodiments in FIGS. 1 through 6 is quite adequate to provide a strong magnetic field to attract the jacks. The metal of the magnet would preferably be alnico number 5 or a number 8 ceramic material. The jacks need only have one crossbar made of a ferromagnetic material and they will be attracted quite strongly to the ball, but once released from the ball, they revert to their non-magnetized status and will not be attracted to one another. Clearly, if they clustered together in the absence of the ball, it would impede the player in his efforts to pick them up one at a time, which is the purpose of the game.

Figure 9:
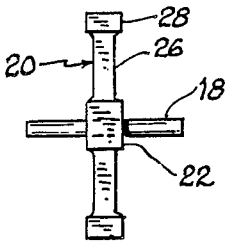
FIG. 9 is an enlarged side elevation view of the jack, taken along the axis of one of the plastic crossbars; and, FIG. 10 illustrates the ball and jack set with the jacks clinging to the surface of the magnetized ball.
Figure 10:
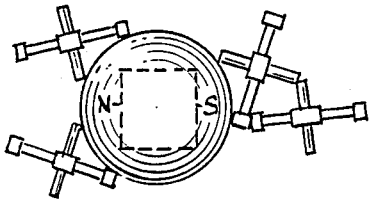

The jacks could have more than one crossbar made of ferromagnetic material, but in the preferred embodiment, a single crossbar 18 is ferromagnetic. The other crossbars 20 are molded as a unit, with a central, square hub 22 and four radial spokes 24 which, in opposed pairs, define the crossbars 20. A central bore through the hub 22 permits the ferromagnetic crossbar 18 to be press-fitted into the crossbars as can be visualized from an inspection of FIG. 9.

It is desirable to keep the jacks light-weight so that they are easily picked up by the ball. To this end, the plastic crossbars 20 have a narrow, neck region 26, each of which terminates in an enlarged foot 28. The neck regions of the crossbars could be as narrow as a sixteenth of an inch, with the feet being somewhat expanded so that the jacks are more durable and work better on an irregular surface.

The single ferromagnetic crossbar 18 can be a length of stiff wire, and is obviously very inexpensive. By making only a single crossbar ferromagnetic, the cost is thus kept down to a bare minimum, and the weight is also kept low, and there is sufficient ferromagnetic material by virtue of the single crossbar to permit it to be strongly attracted to the magnetic ball. The plastic crossbars with the axial bore for the ferromagnetic crossbar can be made in a single molding operation using a small, relatively inexpensively produced mold, so that the entire start up cost of producing the set is minimal, especially if the ball embodiment of FIGS. 4 through 6 is used, in which existing balls can be drilled out with an off-the-shelf cylindrical magnetic bar 16 subsequently inserted into the bore.

Thus, with either of the ball embodiments, in using the jack with at least one ferromagnetic crossbar, children using the game will be exposed to the novelty and advantage of being able to sweep the ball through the jacks when through with the game, with the jacks clinging firmly to the ball. Although the range of the invention as set forth in the claims is somewhat beyond the specific embodiments shown, as described as above this configuration of the jacks is one of several possible configurations but is considered optimal in economy of production costs, minimal weight, strength, and operation when in use. It is hopeful that this set will somewhat revitalize the game of ball and jacks, and will slightly ease the frustration of parents caused by the general proliferation of game parts throughout the house and their concomitant absence from the game for which the parts are necessary to play.

What is claimed is:

1. A magnetically coupled ball and jack set comprising:

(a) A resilient ball incorporating magnetic means;

(b) A plurality of jacks;

(c) Each of said jacks comprising three substantially mutually orthogonal crossbars joined at one another at their centers; and, (d) At least one of said crossbars being ferromagnetic in character such that said jacks will cluster around and cling to said ball to facilitate grouping said ball and jacks when not in use.

2. Structure according to claim 1 wherein said magnetic means comprises a cylindrical magnet completely encapsulated within said resilient ball.

3. Structure according to claim 1 wherein said resilient ball defines a transverse bore therethrough and said magnetic means comprises an elongated magnet inserted into said bore.

4. Structure according to claim 3 wherein said magnet passes through the center of said ball and the length of said magnet is between two-sixteenths and three-sixteenths of an inch shorter than the diameter of said ball to retain its resilience and bounce adequately in the regions adjacent said bore at the surface of said ball when said magnet is centrally positioned in said ball.

5. Structure according to claim 1 wherein one of said crossbars is ferromagnetic and the other two crossbars are plastic.

6. Structure according to claim 5 wherein said ferromagnetic crossbar is shorter than said plastic crossbars.

7. Structure according to claim 5 wherein said two plastic crossbars are molded as an integral unit lying in a plane, and defining a central hub, there being an axial bore through the central hub through which said ferromagnetic crossbar inserted.

8. Structure according to claim 7 wherein said ferromagnetic crossbar is on the order of one half inch long and the other two crossbars are on the order of three quarters of an inch long.

9. Structure according to claim 7 wherein said plastic crossbars have a narrowed neck region on each side of the center, the respective centers, and an expanded foot each end thereof.

* * * * *